US005275505A

United States Patent [19]

Wilcox

[11] Patent Number: 5,275,505

[45] Date of Patent: Jan. 4, 1994

[54] LOCKING SYSTEM FOR BOAT WATER-LIFTS

[75] Inventor: Paul E. Wilcox, Bellevue, Wash.

[73] Assignee: Waterfront Construction, Inc., Kirkland, Wash.

[21] Appl. No.: 5,902

[22] Filed: Jan. 15, 1993

[51] Int. Cl.[5] ..... B63C 3/06

[52] U.S. Cl. ..... 405/3; 114/44; 114/48; 405/4

[58] Field of Search ..... 405/1–; 114/44–; 254/10; 414/678, 471, 477, 478

[56] References Cited

U.S. PATENT DOCUMENTS

| | | | |
|---|---|---|---|
| 2,505,832 | 5/1950 | Lange | 405/3 |
| 3,021,965 | 2/1962 | Harvey | 405/3 X |
| 4,022,027 | 5/1977 | Tetzner | 405/3 |
| 4,329,082 | 5/1982 | Gillis | 114/48 X |
| 4,895,479 | 1/1990 | Michaelsen et al. | 405/4 X |
| 5,051,027 | 9/1991 | Horton | 114/44 X |
| 5,184,914 | 2/1993 | Basta | 405/3 |

*Primary Examiner*—Dennis L. Taylor
*Attorney, Agent, or Firm*—Seed and Berry

[57] ABSTRACT

The piston rod of a lift cylinder unit on a boat lift is selectively locked from extending or retracting by a locking mechanism having a clamping ring which is sleeved on the piston rod and is biased into locking position by a compression spring engaging a piston in a locking cylinder. This cylinder is selectively supplied with pressurized water to compress the spring and thereby release the clamping ring. Hydraulic lines extend to the lift cylinder and locking cylinder from a control manifold located adjacent the boat lift for remotely operating the lift and the locking mechanism.

13 Claims, 6 Drawing Sheets

FIG. 9
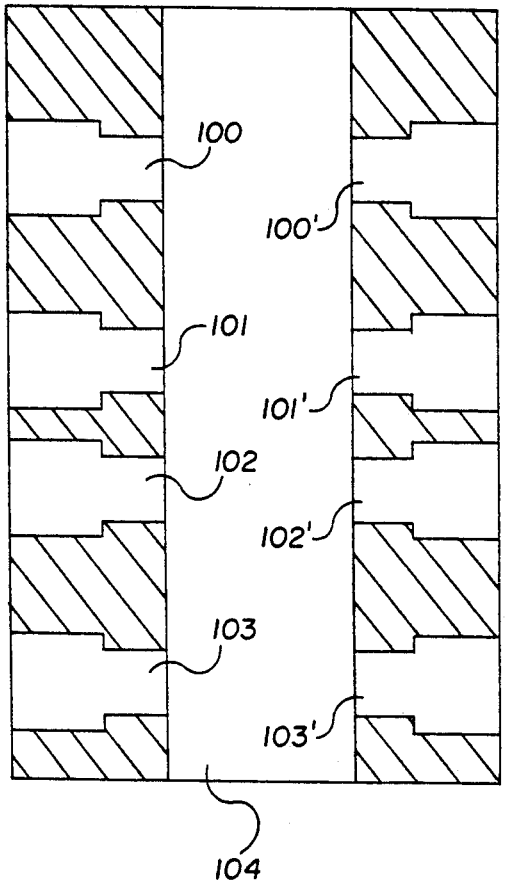
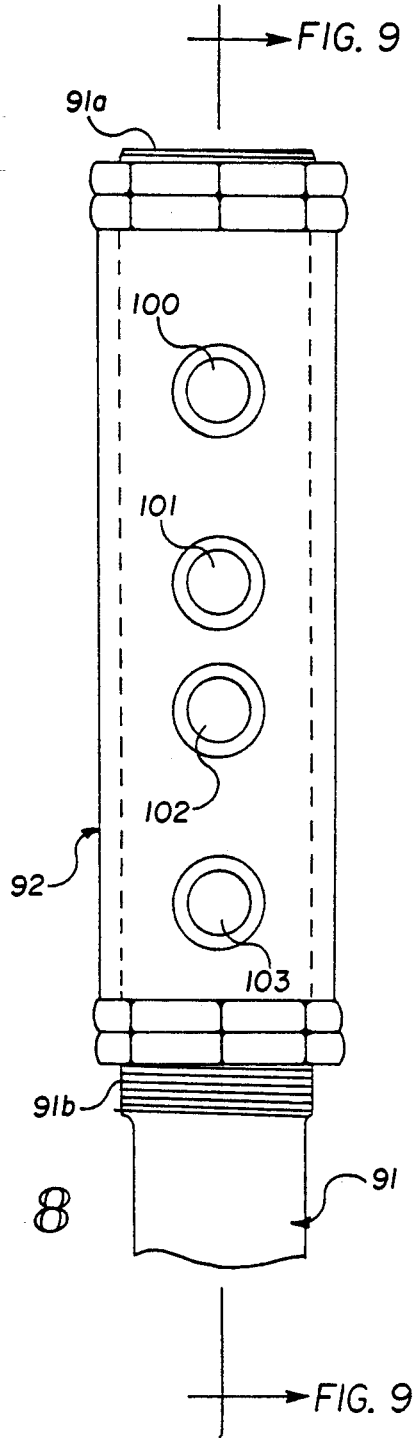
FIG. 8

LOCKING SYSTEM FOR BOAT WATER-LIFTS

DESCRIPTION

1. Technical Field

The present invention relates to lifts actuated by water pressure acting on a hydraulic cylinder unit for raising and storing boats out of the water, commonly referred to as "water-lifts," and more particularly to a mechanism for locking the lift in elevated position.

2. Background of the Invention

In the most common water-lifts for boats a boat cradle is swing-mounted on two pairs of parallel link units which are in turn swing-mounted on a base frame resting on the bottom. A hydraulic cylinder unit, comprising a lift cylinder, piston, and piston rod, is mounted between the base frame and one of the parallel link units so that extension of the piston rod from the lift cylinder causes the parallel link units and cradle to swing upwardly. The lift cylinder is supplied with pressurized water from any convenient source to raise the lift and is lowered by emptying the cylinder.

In the past the boat cradle has usually been held in position by one or the other of two arrangements, and namely, by raising the parallel linkage past center (past a vertical position) to engage a stop, or by latching the lift cylinder unit such that its piston rod cannot retract relative to its cylinder. Such latching has been accomplished by a dog swing-mounted on the upper end of the lift cylinder and arranged to swing down by gravity into locking engagement with a stop when the desired elevation of the boat cradle has been reached. This stop has been provided by using a tubular piston rod and longitudinally slotting the rod so that the dog can enter the slot and engage the upper edge thereof, when the piston rod then retracts slightly, responsive to draining the lift cylinder. Release of the dog is accomplished by manually pulling on a pull cord or the like attached to the dog, but normally this cannot be accomplished until the piston rod is first extended slightly responsive to pressurizing the lift cylinder. The present invention aims to provide a superior locking system for locking the cylinder unit in cradle-raised position which can be easily actuated and released remotely from the locking mechanism as by manipulation of a handle on a dock or float at a location adjacent the boat lift, and which can be released without first having to pressurize the lift cylinder.

SUMMARY OF THE INVENTION

The locking system of the present invention includes a clamping ring sleeved on the piston rod of the lift cylinder. The ring is split by a longitudinal slot and has a pair of clamp arms which cause the ring to firmly grip the piston rod when the clamp arms are pulled together by action of a compression spring. This spring is mounting in a hydraulic locking cylinder unit having a cylinder connected to one of the clamp arms, a piston engaged by the spring, and a piston rod connected to the other clamp arm. The clamping ring is in locking position unless the locking cylinder unit is charged with pressurized water.

Respective combination supply and drain hoses extend from a conveniently located control manifold to the lift cylinder unit and locking cylinder unit. The control manifold is supplied with pressurized water from a suitable source and has a drain line which normally conveniently dumps into the body of water occupied by the boat lift. Valving in the control manifold makes it possible to selectively charge and drain the lift cylinder and locking cylinder for raising and lowering the lift and for locking and unlocking the piston rod of the lift cylinder unit. The control manifold can be operated by a 3-position handle having a lift locking position, a lift raising position, and a lift lowering position.

BRIEF DESCRIPTION OF THE DRAWINGS

FIG. 8 is a plan view of the manifold assembly; and

FIG. 9 is a longitudinal sectional view of the manifold without the spool, and taken as indicated by line 9—9 in FIG. 8.

DETAILED DESCRIPTION OF THE INVENTION

Figure 1:
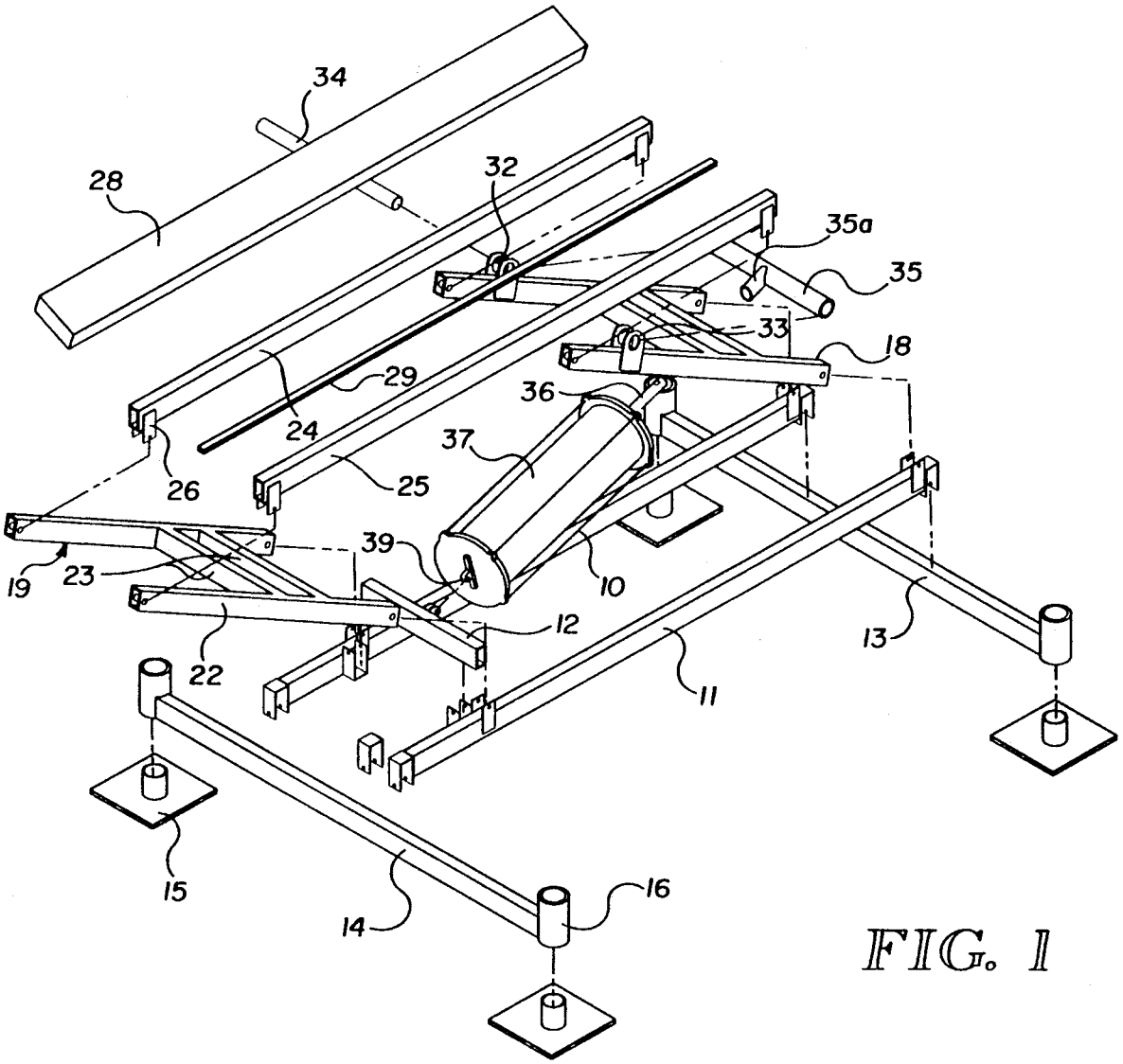
FIG. 1 is an exploded view of a prior art water-lift to which the locking system of the present invention may be applied.
Figure 2:
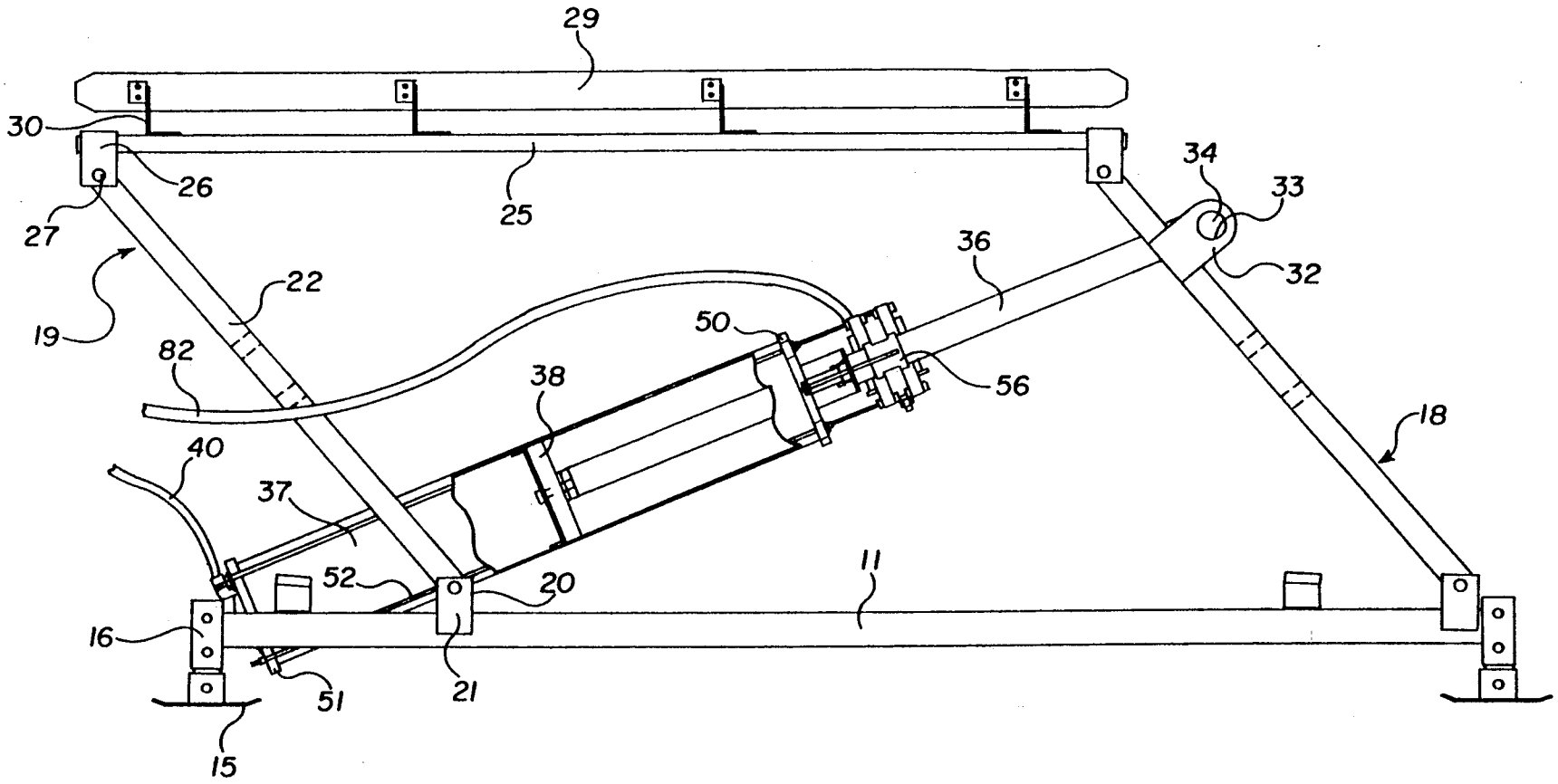
FIG. 2 is a side elevational view of the water-lift provided with the locking mechanism of the present invention.
Figure 3:
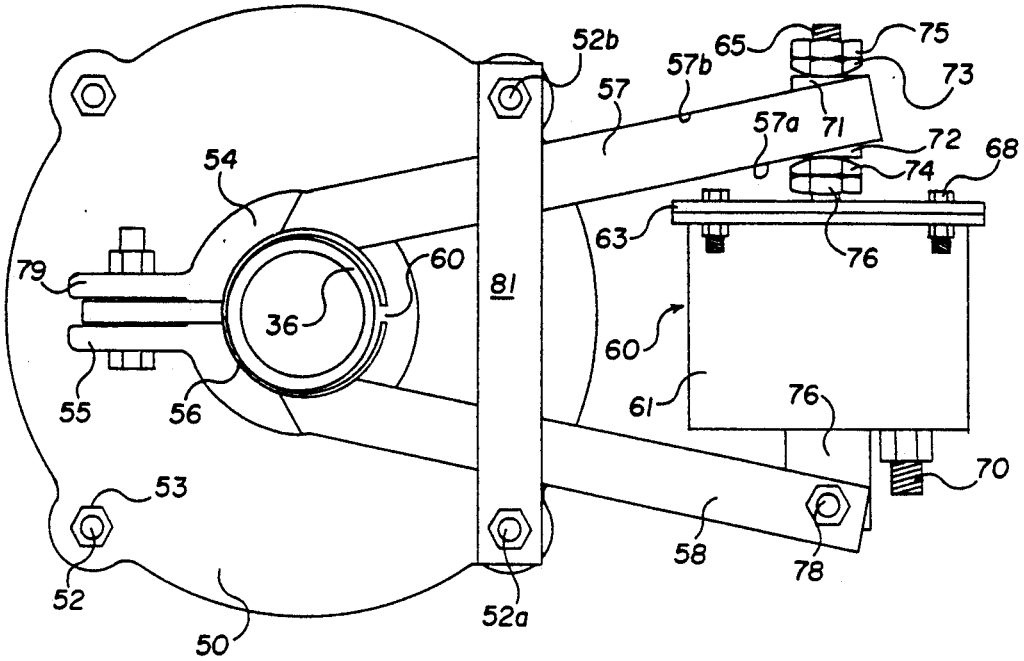
FIG. 3 is an end view of the locking mechanism taken as indicated by line 3—3 in FIG. 2.
Figure 4:
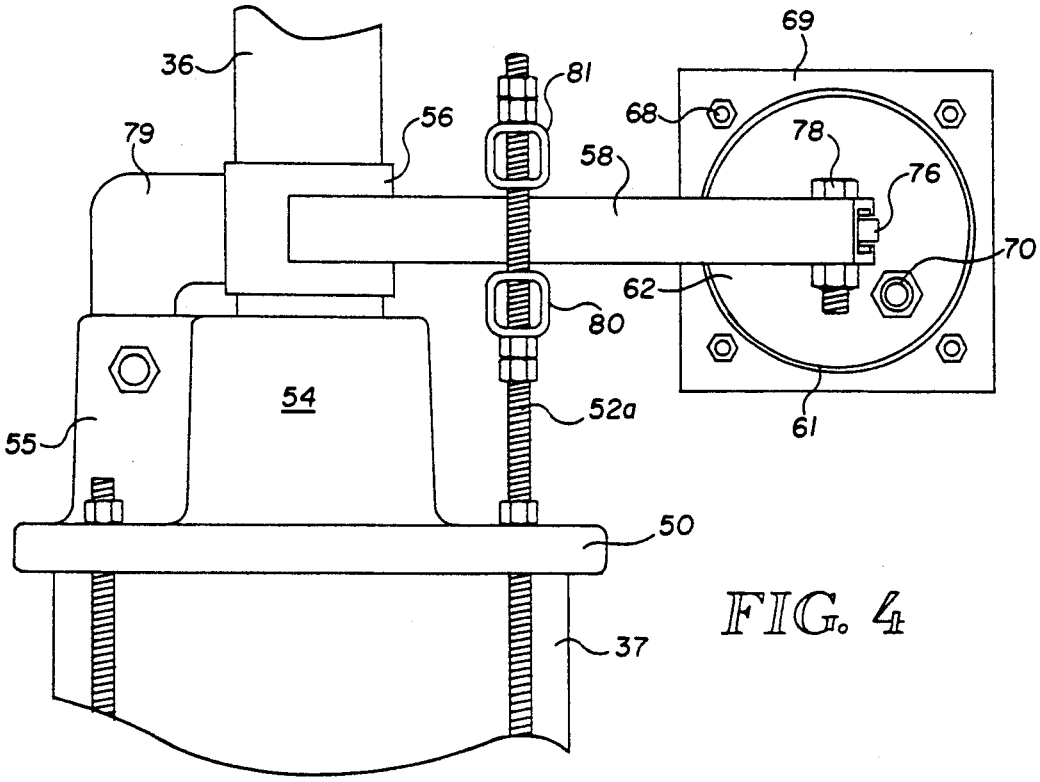
FIG. 4 is a bottom view of the locking mechanism.
Figure 5:
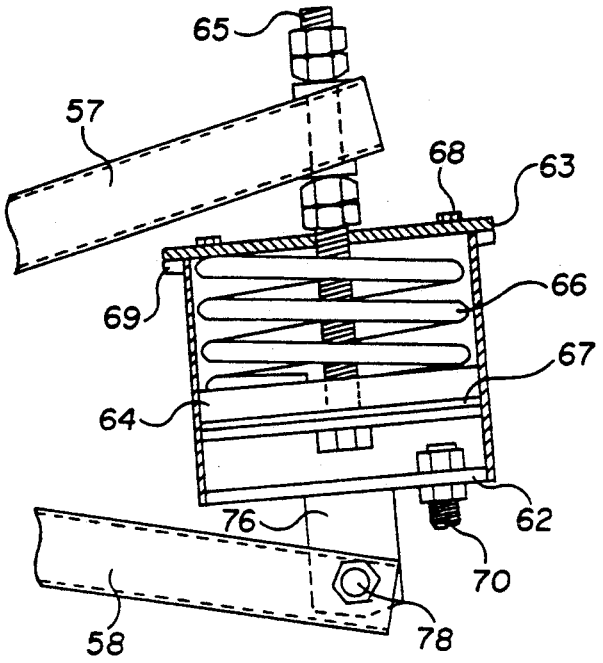
FIG. 5 is a fragmentary end view of the locking mechanism taken like FIG. 3, and with the locking cylinder in horizontal section.

Referring to FIG. 1, a prior art boat lift is illustrated to show an example of a lift to which the present invention is applicable. This lift has a base frame consisting of a pair of longitudinal rails 10–11, a cross-member 12, and front and back frame members 13–14. The latter project laterally at both ends as outriggers to receive bottom-engaging support pad units 15 having upstanding posts interfitting with tubular sockets 16 on the outriggers. A pair of front and back parallel link frames 18–19 are swingably mounted on the rails 10–11 by pivot bolts 20 passing through pairs of upstanding ears 21 on the rails. The link frames 18–19 each comprise a pair of parallel links 22 and a pair of intermediate cross-braces 23. At their upper ends the link frames 18–19 are pivotally connected to the ends of longitudinal cradle rails 24–25 which have pairs of depending ears 26 receiving pivot bolts 27. Padded longitudinal cradle members 28–29 for boat hull engagement diverge laterally from pivot connections with L-shaped mounting brackets 30 on the cradle rails.

The front link frame 18 has two pairs of ears 32 which have aligned holes 33 receiving a cross-bar 34. Freely sleeved on this cross bar is a tube 35 presenting a central socket **35*a* which receives and has a pin connection with the outer end of a tubular piston rod 36. This rod projects from a lift cylinder 37 and is mounted on a piston 38 working in the lift cylinder. The aft end of the cylinder 37 has a mounting ear 39 receiving a pivot bolt passing through a pair of complementary ears provided on the center of the cross member 12**.

Pressurized water is supplied to the aft end of the cylinder 37 through a hose 40 to extend the piston rod by pressure behind the piston 38, and this causes the parallel link frames 18–19 and cradle 24–25 to swing upwardly in the forward direction thereby lifting a boat resting on the cradle members 28–29. Lowering of the boat is accomplished by draining water from the cylinder 37 through the hose 40 after closing a supply valve and opening a drain valve at opposite ends of a manifold to which the hose 40 is connected intermediate the supply and drain valves. This manifold is preferably conveniently located on the dock or float beside which the boat lift is positioned.

The cylinder 37 has commonly been constructed with front and back end caps 50–51 which are clamped into position by four tie rods 52 passing through the end caps and threaded to receive nuts 53. The front end cap 50 is provided with a front boss 54 through which the piston rod 36 passes, and commonly has also had a front pair of mounting ears 55 above the boss 54. These ears 55 have been previously provided to receive a locking dog pivotally mounted between the ears to fit into a longitudinal slot in the piston rod located such that when the cradle was raised to a predetermined height the locking dog would swing downwardly into the slot and engage the upper edge of the slot when the cradle was then lowered slightly. As previously discussed, in the use of this prior art locking system it was necessary to slightly raise the cradle and then swing up the locking dog out of the slot in the piston rod in order to be able to lower the cradle.

The improved locking system of the present invention will now be discussed. In accordance with the present invention a clamping ring 56 is sleeved on the piston rod 36 forwardly of the lift cylinder 37. This clamping ring has a pair of diverging clamp arms 57–58 fixed thereto and has a longitudinal slot 60 midway between the clamp arms extending for the full length of the clamping ring. It will be apparent that if the arms 57–58 are pulled together, thereby tending to close the slot 60, the clamping ring 56 will grip the piston rod 36. The clamp arms 57–58 are arranged to be pulled together by operation of a spring-loaded locking cylinder assembly 60 mounted between the outer ends of the clamp arms. This cylinder assembly 60 comprises a cylinder 61 having end plates 62–63, a piston 64 with a rod 65 in the form of a bolt extending freely through the end plate 63, and a compression spring 66 in the cylinder 61 between the piston 64 and the end plate 63. The piston 64 comprises a disc of high-density self-lubricating material which is circumferentially grooved to receive an O-ring 67. The end cap 62 is welded in place as an insert, and the other end cap 63 is held by bolts 68 on a square mounting collar 69 welded to the cylinder 61. A hose receiving nipple 70 is mounted on the end plate 62.

The clamp arms 57–58 may be fabricated from square tubular stock and are weld-connected to the clamping ring 56. Near its outer end the clamp arm 57 has its inner and outer walls **57*a*–57*b* slotted for passage of the piston rod 65 therethrough. These slotted walls of clamping arm 57 are engaged by beveled washers 71–72 which in turn are engaged by rounded faces of a pair of nuts 73–74. The latter are confined by a pair of jam nuts 75–76. The fit between the nuts 73–74 and the beveled washers 71–72, and between the beveled washers and the clamp arm 57 is loose enough to provide sufficient play between the arm 57 and the piston rod 65 for pivotal movement of the arm 57 relative to the cylinder unit 61 during clamping and releasing motions of the clamp arms 57–58. The clamp arm 58 has its inner wall 57*a* notched at the outer end of the arm 57 so that it can straddle a mounting lug 76 projecting from the end plate 62. A pivot bolt 78 passes through the clamp arm 57 and lug 76** with a relatively loose fit.

The clamping ring 56 has an L-shaped anchoring element extension 79 projecting outwardly therefrom diametrically opposite from the slot 60 and then bending toward the cylinder end cap 50 to fit between the ears 55 on the cap 50 to secure the clamping ring 56 against endwise movement relative to the lift cylinder 37. Prevention of such movement is assisted by a pair of tubular confining members 80–81 facing the lateral sides of the clamp arms. These confining members 80–81 are held in place by extending two of the tie rods 52 to provide 35 mounting portions **52*a*–52*b* which pass through the confining members and have inner and outer pairs of nuts 82 and 83** threaded thereon to position the confining members.

Preferably the clamping ring 56 is positioned on the piston rod 36 such that the clamp arms 57–58 extend in a generally horizontal direction. Hence, the lift cylinder cap 50 is turned ninety degrees relative to the previous position in which the ears 55 were positioned above the boss 54 to receive the locking dog in the prior art locking arrangement previously discussed. It will be appreciated that one of the advantages of the illustrated preferred embodiment of the present invention is that the described prior art units can be easily retrofitted with the present invention.

In the operation of the invention, the compression spring 66 normally pulls the clamp arms 57–58 toward one another to urge the clamping ring 56 into a locking position gripping the piston rod 36 of the lift cylinder. This clamping action of the spring 66 is overcome by introducing pressurized fluid into the locking cylinder unit 60 through a hose 82 connected to the nipple 70 whenever the boat cradle is to be raised or lowered. Opening the other end of the hose 82 to a drain automatically results in locking of the clamping ring 56 against the piston rod 36 of the lift cylinder unit. As previously discussed, the lift cylinder 37 can be supplied with pressurized water through a hose 40 to raise the cradle and may be drained through the hose 40 to lower the cradle.

Figure 6:
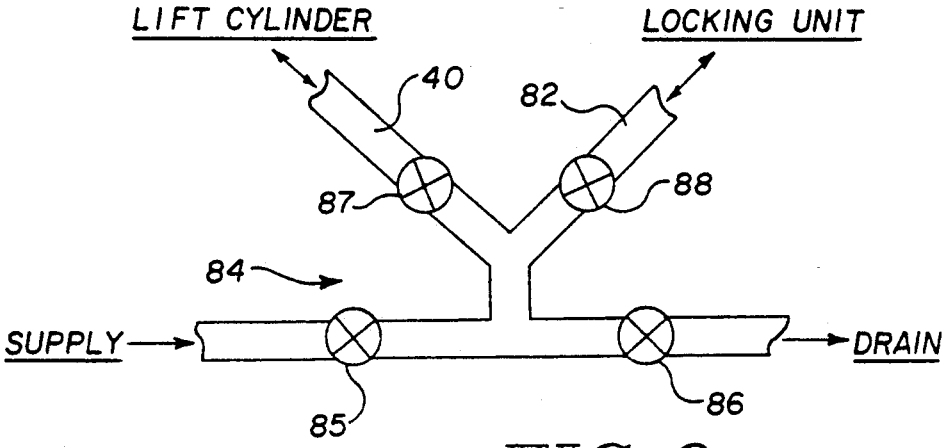
FIG. 6 is a schematic of a supply and drain valving arrangement for the locking mechanism.
Figure 7:
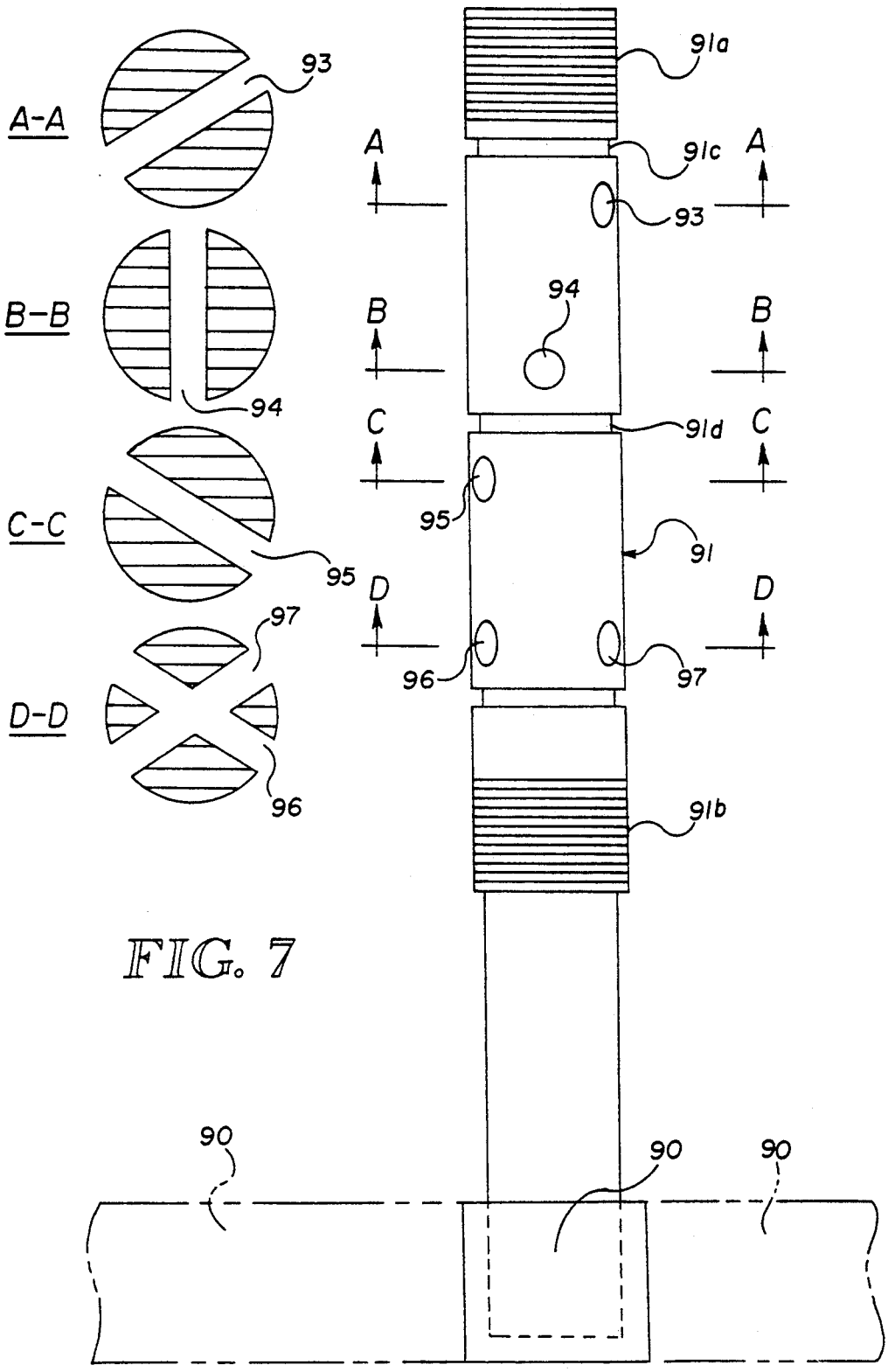
FIG. 7 is a plan view of the rotary spool for a preferred supply and drain manifold for the locking mechanism, and showing to the left of the spool the corresponding positions of the transverse passages through the spool.

Directing attention to FIG. 6, the hoses 40, 82 may be connected to a control manifold 84 having a supply valve 85, drain valve 86, lift cylinder control valve 87, and locking cylinder control valve 88. Opening of the valves 85, 87 and 88 results in raising of the lift. Then, closing the supply valve 85 and opening the drain valve 86 results in locking of the lift in raised position. Alternatively, both the supply valve 85 and the lift cylinder control valve 87 can be closed, and the other two valves 86, 88 opened to lock the lift in raised position. This latter procedure is preferred and can be performed by operation of a 3-position handle 90 on a rotary spool 91 in a manifold block 92. As shown in FIGS. 7–9, the spool 91 has five passages 93 through 97 therethrough for selectively registering with four sets of threaded ports 100—100′, 101—101′, 102—102′, and 103—103′ in the block 92 which intersect a central longitudinal bore 104 through which the spool 91 extends.

Ports 100–101 are drain ports; ports 102, 103 are drain ports; ports 100′, 102′ are a drain port and a supply port, respectively, for the lift cylinder unit; and ports 101′ and 103′ are a drain port and a supply port, respectively, for the locking cylinder unit. The spool 91 is held in position by nuts screwed onto threaded portions **91*a*, 91*b*** thereof external of the manifold block 92. The spool 91 has three circumferential grooves 91*c*, 91*d* and 91*e* for receiving O-rings and the outer ends of the eight ports in the manifold block 92 are counter-bored to receive O-rings. Similarly, the ends of the bores 93–97 in the spool 91 can be counter-bored and fitted with O-rings.

In the operation of the manifold unit the handle 90 is in a stop position (lift locking position) when aimed straight up, a lift lowering position when turned to the left when viewed as in FIG. 7, and in a lift raising position when turned to the right. In the stop position all of the ports in the manifold block are closed by the spool 91 except the drain ports 101—101' for the locking cylinder which interconnect via passage 94 in the spool 91. This drains the locking cylinder so that the locking spring 66 will cause the clamp arms 57–58 to be pulled toward one another and thereby lock the clamping ring 56 to the piston rod 36 of the lift cylinder unit.

In the lift lowering position of the handle 90 the locking cylinder supply ports 103, 103' are connected via the spool passage 97 to release the clamping ring 56, and the drain ports 100—100' are connected via the spool passage 93 to drain the lift cylinder. The other ports are closed by the spool.

In the lift raising position of the handle 90 the supply ports 102—102' and 103—103' are interconnected by spool passages 95 and 96, respectively, to pressurize both the lift cylinder and the locking cylinder, and the other ports are closed by the spool.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A boat lift comprising:

a boat cradle, a base frame, lift means between said cradle and base frame for raising and lowering said cradle including a hydraulic lift cylinder having a piston with a piston rod projecting from said lift cylinder, extension of said piston rod from said lift cylinder responsive to charging said lift cylinder with pressurized water functioning to raise said cradle, and retraction of said piston into said lift cylinder responsive to discharging water from the lift cylinder functioning to permit said cradle to lower;

rod locking means connected to said lift cylinder for normally clamping said piston rod and thereby preventing relative movement between the lift cylinder and piston rod;

and unlocking means including an unlocking cylinder connected to said locking means for releasing said piston rod from said locking means when said unlocking hydraulic cylinder is charged with pressurized water; and a water control system comprising:

water supply means for selectively charging both of said cylinders with pressurized water to release said locking means and raise said cradle;

water dumping means for selectively dumping water from said unlocking cylinder to activate said locking means;

and water supply and dumping means for selectively charging said unlocking cylinder with pressurized water and dumping water from said lift cylinder to release said locking means and lower said cradle.

2. A boat lift according to claim 1 in which said locking means comprises a clamping ring sleeved on said piston rod and having a slot along its length, a pair of clamping arms extending from said clamping ring, and a spring normally biasing said clamping arms such as to narrow said slot.

3. A boat lift according to claim 2 in which said unlocking cylinder is connected to one of said clamping arms and has a biased piston with a respective piston rod connected to the other one of said clamping arms, said spring being a compression spring surrounding said respective piston rod and biasing said biased piston away from said other one of the clamping arms, said unlocking cylinder having a water port located in said unlocking cylinder on the opposite side of said biased piston from said compression spring for the passage of water to and from the unlocking cylinder in response to operation of said water control system.

4. A boat lift according to claim 1 in which said water control system also comprises means for selectively dumping water from said unlocking cylinder without dumping water from said lift cylinder when said cradle is in a raised position.

5. A locking system for a boat lift having a hydraulic lift cylinder with a piston rod projecting from one end thereof from a piston therein, extension of said piston rod responsive to charging the lift cylinder with pressurized water functioning to raise the boat lift, said locking system comprising:

a clamping ring with a slot therealong for occupying a position sleeved on said piston rod;

two clamping arms diverging from said ring adjacent opposite sides of said slot;

an unlocking cylinder connected to one of said arms;

a respective piston rod connected to the other one of said clamping arms and extending into said unlocking cylinder;

a respective piston mounted on said respective piston rod in said unlocking cylinder;

a compression spring surrounding said respective piston rod and biasing said clamping arms toward one another to narrow said slot and thereby lock said clamping ring on the piston rod of said lift cylinder;

a port in said unlocking cylinder for introducing pressurized water to offset the biasing by said spring and thereby unlock said clamping ring;

and means for connecting said clamping ring to a lift cylinder.

6. A locking system according to claim 5 in which said system also comprises a water control manifold having a housing with rotary spool therein having an exposed handle thereon, said manifold having a first supply port and a drain port for connecting respectively to a pressurized water supply and a water drain, and having a second supply port and a discharge port connected to said port in said unlocking cylinder, said handle having a boat lifting position and a boat lowering position in both of which positions said first supply port is connected via said spool to said second supply port and said spool blocks said discharge port from said drain port, and said handle also having a lift locking position in which said discharge port is connected to said drain port via said spool and in which said first supply port is blocked by said spool from said second supply port.

7. A locking system according to claim 6 in which said manifold housing also has a respective supply port and discharge port for connection to said lift cylinder whereby said lift cylinder is supplied with water when said handle is in said boat lifting position and whereby said lift cylinder drains when said handle is in said boat lowering position.

8. A locking system for a boat lift of the type comprising:

a boat cradle;

a base frame;

parallel linkage means pivotally connected to said cradle and base frame for raising said cradle responsive to upward swinging of said cradle relative to said base frame;

a hydraulic cylinder unit including a cylinder pivotally connected to said base frame, a piston in said cylinder, and a piston rod projecting out of said cylinder from said piston and pivotally connected to said parallel linkage means such that extension of said piston rod from said cylinder raises said cradle, and retraction of said piston rod into said cylinder lowers said cradle;

and water supply and discharge means for selectively supplying pressurized water to said cylinder for extending said piston rod, and for selectively emptying water from said cylinder for retracting said piston rod;

said locking system comprising:

a clamping device anchored to said cylinder, said device having a locking position gripping said piston rod to prevent relative movement between said piston rod and cylinder when said cradle is in raised position, and having a released position whereat said piston rod is free to move relative to said cylinder;

spring means biasing said clamping device into said locking position;

and hydraulic cylinder means connected to said clamping device and having a water port, said hydraulic cylinder means being arranged to opposed the bias of said spring means when supplied with pressurized water through said water port to thereby move said clamping device into its said released position from its locking position.

9. A locking system according to claim 8 in which said clamping device includes a clamping ring sleeved on said piston rod and having a slot along its length, and includes a pair of clamp arms extending from said clamping ring and arranged to be biased toward one another by said spring means.

10. A locking system according to claim 9 in which said clamping ring is connected to said cylinder.

11. A locking system according to claim 9 in which said clamp arms are confined against movement endwise of said cylinder by confining elements connected to said cylinder.

12. A locking system according to claim 9 in which said cylinder has end caps held in place by multiple tie rods extending along the outside of said cylinder, two of said tie rods projecting endwise beyond said clamp arms, and confining elements mounted on said two tie rods for confining said clamp arms relative to said cylinder.

13. A locking system according to claim 12 in which said clamping ring is connected to an adjacent one of said end caps.

* * * * *